US010648284B2

(12) United States Patent
Hunter

(10) Patent No.: US 10,648,284 B2
(45) Date of Patent: May 12, 2020

(54) METHODS AND SYSTEMS FOR A SEAL TO MAINTAIN CONSTANT PRESSURE WITHIN A TOOL WITH A SLIDING INTERNAL SEAL

(71) Applicant: COMITT WELL SOLUTIONS US HOLDING INC., Katy, TX (US)

(72) Inventor: William Hunter, Houston, TX (US)

(73) Assignee: Comitt Well Solutions LLC, Katy, TX (US)

( * ) Notice: Subject to any disclaimer, the term of this patent is extended or adjusted under 35 U.S.C. 154(b) by 187 days.

(21) Appl. No.: 15/935,286

(22) Filed: Mar. 26, 2018

(65) Prior Publication Data

US 2019/0292880 A1 Sep. 26, 2019

(51) Int. Cl.

| | |
|---|---|
| ***E21B 34/10*** | (2006.01) |
| ***E21B 43/26*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/14* (2013.01); *E21B 43/26* (2013.01); *E21B 2034/007* (2013.01)

(58) Field of Classification Search

None

See application file for complete search history.

(56) References Cited

U.S. PATENT DOCUMENTS

| | | | | |
|---|---|---|---|---|
| 2006/0201675 | A1* | 9/2006 | Ferguson | E21B 43/114 166/298 |
| 2009/0032255 | A1* | 2/2009 | Surjaatmadja | E21B 33/13 166/281 |
| 2010/0096127 | A1* | 4/2010 | Jordy | E21B 34/08 166/269 |
| 2012/0292032 | A1* | 11/2012 | Themig | E21B 34/063 166/310 |
| 2013/0081824 | A1* | 4/2013 | Hill, Jr. | E21B 43/16 166/375 |
| 2013/0248192 | A1* | 9/2013 | Cook | E21B 33/127 166/308.1 |
| 2014/0034308 | A1* | 2/2014 | Holderman | E21B 34/08 166/279 |
| 2015/0285029 | A1* | 10/2015 | Tolman | E21B 43/12 166/297 |

* cited by examiner

*Primary Examiner* — Yong-Suk Ro

(74) *Attorney, Agent, or Firm* — Pierson IP, PLLC

(57) ABSTRACT

Systems and methods to maintain constant pressure within a chamber within a tool via a sliding seal, wherein the seal moves to increase or decrease the size of the chamber.

16 Claims, 3 Drawing Sheets

METHODS AND SYSTEMS FOR A SEAL TO MAINTAIN CONSTANT PRESSURE WITHIN A TOOL WITH A SLIDING INTERNAL SEAL

BACKGROUND INFORMATION

Field of the Disclosure

Examples of the present disclosure relate to systems and methods to maintain constant pressure within a chamber via a sliding seal, wherein the seal moves to increase or decrease the size of the chamber.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

Conventionally, it is required to insert a water jet cutter inside casing to create perforations within the casing. Once the perforations within the casing are created, the water jet cutter may be removed from the casing, and a tool is inserted into the casing, wherein the tool is positioned based on the locations of the perforations in the casing. To generate sufficient pressure to create the fractures in the formations, the tool utilizes a packer outside of the tool to isolate a zone of interest. The packers are conventionally set mechanically through manipulating the string, i.e.: moving up, moving down, rotation or combination of these movements. To this end, conventional systems require mechanically set chambers and mechanical packers positioned outside of the tool to create the perforations within the casing and to isolate zones above from zones below before treating.

Accordingly, needs exist for system and methods for fracturing systems with a sliding seal within a tool that is configured to move within the tool to dynamically change a size of a chamber within the tool based on the pressure within the tool, wherein the sliding seal may move to maintain a substantially constant pressure within the chamber.

SUMMARY

Examples of the present disclosure relate to systems and methods utilizing a sliding seal to maintain a substantially constant pressure within a chamber while dynamically changing a fluid flow rate of fluid through the camber. The sliding seal maintains the substantially constant pressure by changing a volume of the chamber.

Embodiments may include a tool within an inner diameter, first set of nozzles, second set of nozzles, sliding seal, and pressure adjustable member.

The inner diameter of the tool may be a hollow passageway that extends from a proximal end of the tool to the distal end of the tool. The inner diameter of the tool may be configured to allow fluid to flow through the tool, from the proximal end of the tool to the distal end of the tool, as well as from the distal end of the tool to the proximal end of the tool. The fluid flow rate through the tool may vary based on desired criteria. For example, the fluid flow rate may include to a sufficient rate that allows a fracturing process to occur within a geological formation.

The first set of nozzles may be holes extending through the circumference of the tool from the inner diameter of the tool to the outer diameter of the tool, wherein the first set of nozzles are configured to control the flow of fluid from a positioned within the inner diameter of the tool to a position away from the outer diameter of the tool. For example, the first set of nozzles may be utilized to perform a fracking operation into a geological formation. The first set of nozzles may be positioned at a first offset from a proximal end of the tool. In embodiments, the first set of nozzles may include a first number of nozzles that are each positioned at an equal angular offset from each other. In embodiments, each of the first set of nozzles may be different types of nozzles or the same types of nozzles.

The second set of nozzles may be holes extending through the circumference of the tool from the inner diameter of the tool to the outer diameter of the tool, wherein the second set of nozzles are configured to control the flow of fluid from a positioned within the inner diameter of the tool to a position away from the outer diameter of the tool. For example, the second set of nozzles may be utilized to perform a fracking operation into a geological formation. The second set of nozzles may be positioned at a second offset from a proximal end of the tool, wherein the first and second offsets are different lengths. In embodiments, the second set of nozzles may include a second number of nozzles that are each positioned at an equal angular offset from each other. In embodiments, the first number may be smaller than the second number. In embodiments, each of the second set of nozzles may be different types of nozzles or the same types of nozzles. In further embodiments, the second set of nozzles may be different types of nozzles than the first type of nozzles, which may regulate the flow of fluid differently.

The sliding seal may be positioned within the inner diameter of the tool. A first end of the sliding seal may include a piston area that is configured to receive first forces applied by fluid flowing through the inner diameter of the tool, and a second end of the sliding seal may be configured to receive second forces applied by the pressure adjustable member. Responsive to the first forces being greater than the second forces, the sliding seal may move towards a distal end of the tool, dynamically increasing the size of the chamber. Responsive to the first forces being less than the second forces, the sliding seal may move towards a proximal end of the tool, which may dynamically decrease the size of the chamber. In embodiments, the first forces may correlate to a fluid flow rate through the inner diameter of the tool, wherein the first forces increase when the fluid flow rate increases and the first forces decrease when the fluid flow rate decreases. Accordingly, the sliding seal may automatically and incrementally adjust the size of the chamber based on the fluid flow rate, such that the pressure within the chamber remains substantially constant with varying fluid flow rates.

The pressure adjustable member may be a spring, piston, etc. positioned between the sliding seal and a distal end of the tool. The pressure adjustable member may be configured to apply forces towards the proximal end of the tool. A first end of the pressure adjustable member may be fixed in place, while a second end of the pressure adjustable member may move based on a compression or elongation of the pressure adjustable member.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
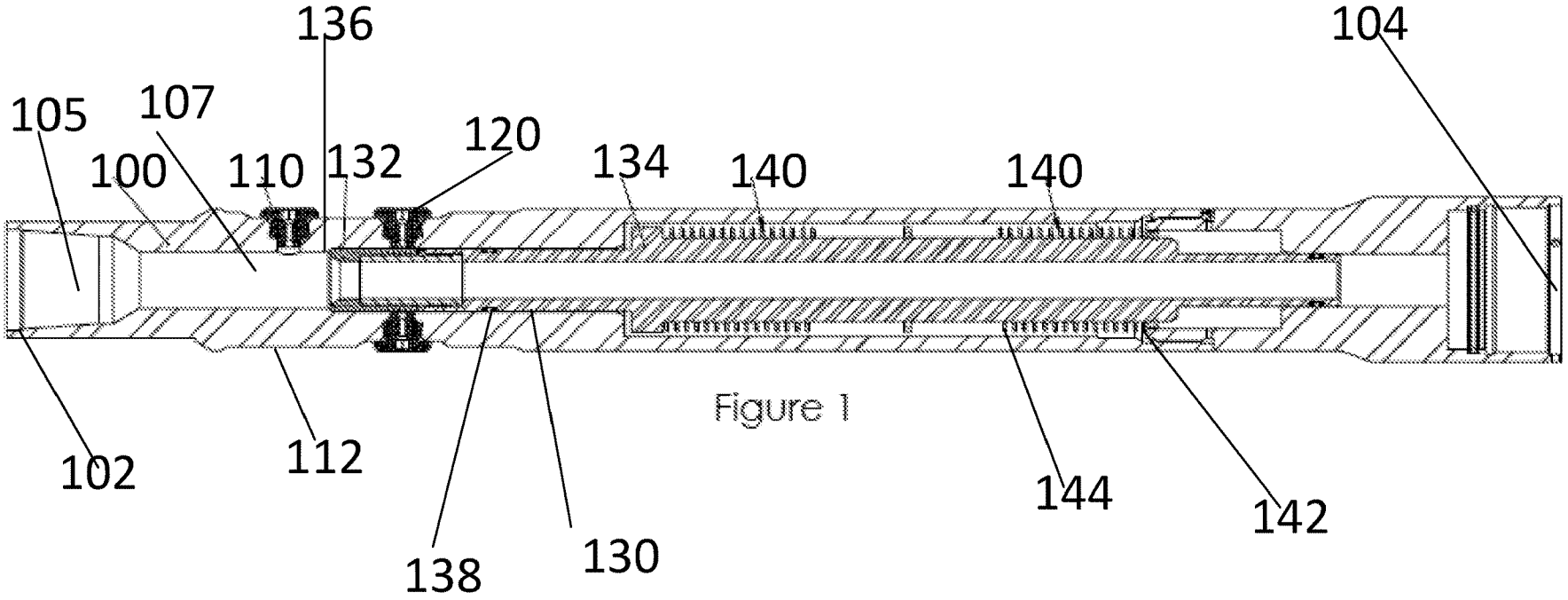
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 in a first mode, according to an embodiment. Tool 100 may include an inner diameter 105, first set of nozzles 110, second set of nozzles 120, sliding seal 130, and at least one pressure adjustable member 140.

Inner diameter 105 may be a hollow passageway forming a chamber 107, wherein the hollow passageway extends from a proximal end 102 of tool 100 to a distal end 104 of tool 100. Inner diameter 105 may be configured to allow fluid to flow through tool 100, from the proximal end 102 to the distal end 104, as well as from the distal end 104 of the tool to the proximal end 102. Fluid may be pumped through inner diameter 105 of tool 100 to activate and deactivate the tool 100, allow a fracturing process to be performed, etc. In embodiments, the first forces may correlate to a fluid flow rate through inner diameter 105, wherein the first forces increase when the fluid flow rate increases and the first forces decrease when the fluid flow rate decreases. Chamber 107 may be positioned above sliding seal 130, wherein chamber 107 may have a smaller diameter than that of proximal end 102 and/or distal end 104.

First set of nozzles 110 may be holes extending through the circumference of the tool 100 from inner diameter 105 of tool 100 to the outer diameter 112 of tool 100. First set of nozzles 110 are configured to control the flow of fluid from a positioned within inner diameter 105 of the tool 100 to a position away from outer diameter 112 of tool 100. For example, first set of nozzles 110 may be utilized to perform a fracking operation into a geological formation. First set of nozzles 110 may be positioned at a first offset from proximal end 102 of the tool. In embodiments, First set of nozzles 110 may include a first number of nozzles that are each positioned at an equal angular offset from each other. In embodiments, each of the nozzles with first set of nozzles 110 may be different types of nozzles or the same types of nozzles.

Second set of nozzles 120 may be holes extending through the circumference of tool 100 from inner diameter 105 of tool 100 to outer diameter 112. Second set of nozzles 120 are configured to control the flow of fluid from a positioned within the inner diameter 105 of the tool 100 to a position away from outer diameter 112. For example, second set of nozzles 120 may be utilized to perform a fracking operation into a geological formation. Second set of nozzles 120 may be positioned at a second offset from a proximal end 102, wherein the first and second offsets are different lengths. In embodiments, Second set of nozzles 120 may include a second number of nozzles that are each positioned at an equal angular offset from each other. In embodiments, the first number may be smaller than the second number. In embodiments, each of the nozzles with the second set of nozzles 120 may be different types of nozzles or the same types of nozzles. In further embodiments, the second set of nozzles 120 may be different types of nozzles than the first type of nozzles, which may regulate the flow of fluid differently.

Sliding seal 130 may be positioned within the inner diameter 105. A first end 132 of sliding seal 130 may include a piston area that is configured to receive first forces applied by fluid flowing through the inner diameter 105 from proximal end 102 towards distal end 104. A second end 134 of sliding seal 130 may be configured to mechanically receive second forces applied by forces 140. Second end 134 may have a slightly smaller diameter than that of first end 132.

Sliding seal 130 may be configured to move between a lip 136 and a seal 138 positioned within inner diameter 105, wherein the positioning of sliding seal may be based on a fluid flow rate through inner diameter 105. Lip 136 may be configured to stop the movement of sliding seal 130 towards proximal end 132, and seal 138 may be configured to stop the movement of sliding seal 130 towards distal end 134. In embodiments, lip 136 may be positioned above or below first set of nozzles 110, and seal 138 may be positioned below second set of nozzles 110.

Responsive to the first forces applied against first end 132 by the flow of fluid in a first direction being greater than the second forces applied against second end 134 in a second direction, sliding seal 130 may move towards distal end 104 of tool 100. This may dynamically and automatically increase the size of the chamber 107. Responsive to the first forces being less than the second forces, sliding seal 130 may move towards a proximal end 102, which may dynamically decrease the size of the chamber 107. Accordingly, sliding seal 130 may automatically and incrementally adjust the size of the chamber 107 based on the fluid flow rate, such that the pressure within the chamber 107 remains substantially constant with varying fluid flow rates. Furthermore, responsive to increasing the fluid flow rate beyond a first fluid flow threshold, sliding seal 130 may move from a position above first set of nozzles 110 to a position below first set of nozzles 110, which may expose first set of nozzles 110 while covering second set of nozzles 120. Responsive to increasing the fluid flow rate past a second fluid flow threshold, sliding seal 130 may move to a position below second set of nozzles 120, exposing both first set of nozzles 110 and second set of nozzles 120. In other embodiments, due to the positioning of lip 132, first set of nozzles 110 may always be exposed and positioned above sliding seal 130.

Additionally, sliding seal 130 may have a diameter that is slightly smaller than that of inner diameter 105, such that there is an annulus between sliding seal 130 and inner diameter 105. This may allow fluid to constantly be circulating through inner diameter 105 and the nozzles, even if the size of chamber 107 remains substantially static. However, if second end 134 is positioned adjacent to seal 138, a seal may be formed across inner diameter 105.

Figure 2:
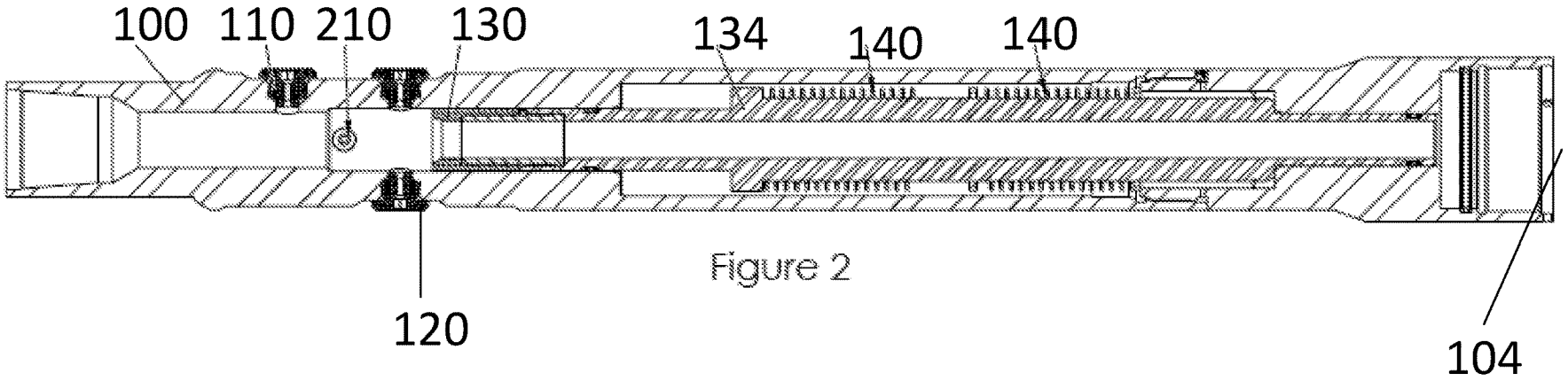
FIG. 2 depicts a tool, according to an embodiment.

Pressure adjustable member 140 may be a spring, piston, etc. positioned between the sliding seal 130 and distal end 104. Pressure adjustable member 140 may be configured to mechanically apply second forces to sliding seal 130 via a sliding sleeve, wherein the second forces are directed towards the proximal end 102. A first end 142 of pressure adjustable member 140 may be fixed in place, while a second end 144 of pressure adjustable member 140 may move based on a compression or elongation of pressure adjustable member 140. Responsive to pressure adjustable member 140 compressing, second end 144 may be positioned more proximate to distal end 104 then when pressure adjustable member 140 is expanded. The compression and expansion of pressure adjustable member may be based on if the fluid flow rate above sliding seal 130, wherein if the greater the fluid flow rate the greater pressure adjustable member 140 compresses FIG. 2 depicts tool 100 in the second mode, according to an embodiment. Elements depicted in FIG. 2 may be substantially similar to those described above. Therefore, for the sake of brevity a further description of these elements is omitted.

As depicted in FIG. 2, responsive to increasing the fluid flow rate through inner diameter of tool 100, sliding seal 130 may automatically move towards distal end 104 of tool 100. This may cause a size of chamber 107 to increase, which may create a substantially constant pressure within chamber 107 even when the fluid flow rate changes.

Furthermore, responsive to sliding seal 130 moving towards distal end 104, sliding seal 130 may expose the second set of nozzles 120 and a third set of nozzles 210 to the fluid flowing through inner diameter 105, wherein the third set of nozzles may be angularly and vertically offset from the first set and second set of nozzles 110, 120. This may allow a fracturing process to occur through both the first set of nozzles 110, the second set of nozzles 120, and third set of nozzles 210 simultaneously when the fluid flow rate through inner diameter 110 is high enough. However, if the fluid flow rate through inner diameter is not high enough, a fracturing process may still occur through only first set of nozzles 110. This may allow for a dynamic process of performing a fracturing process via multiple nozzles while maintaining a substantially constant pressure through chamber 107 by changing the fluid flow rate through inner diameter 105.

Figure 3:
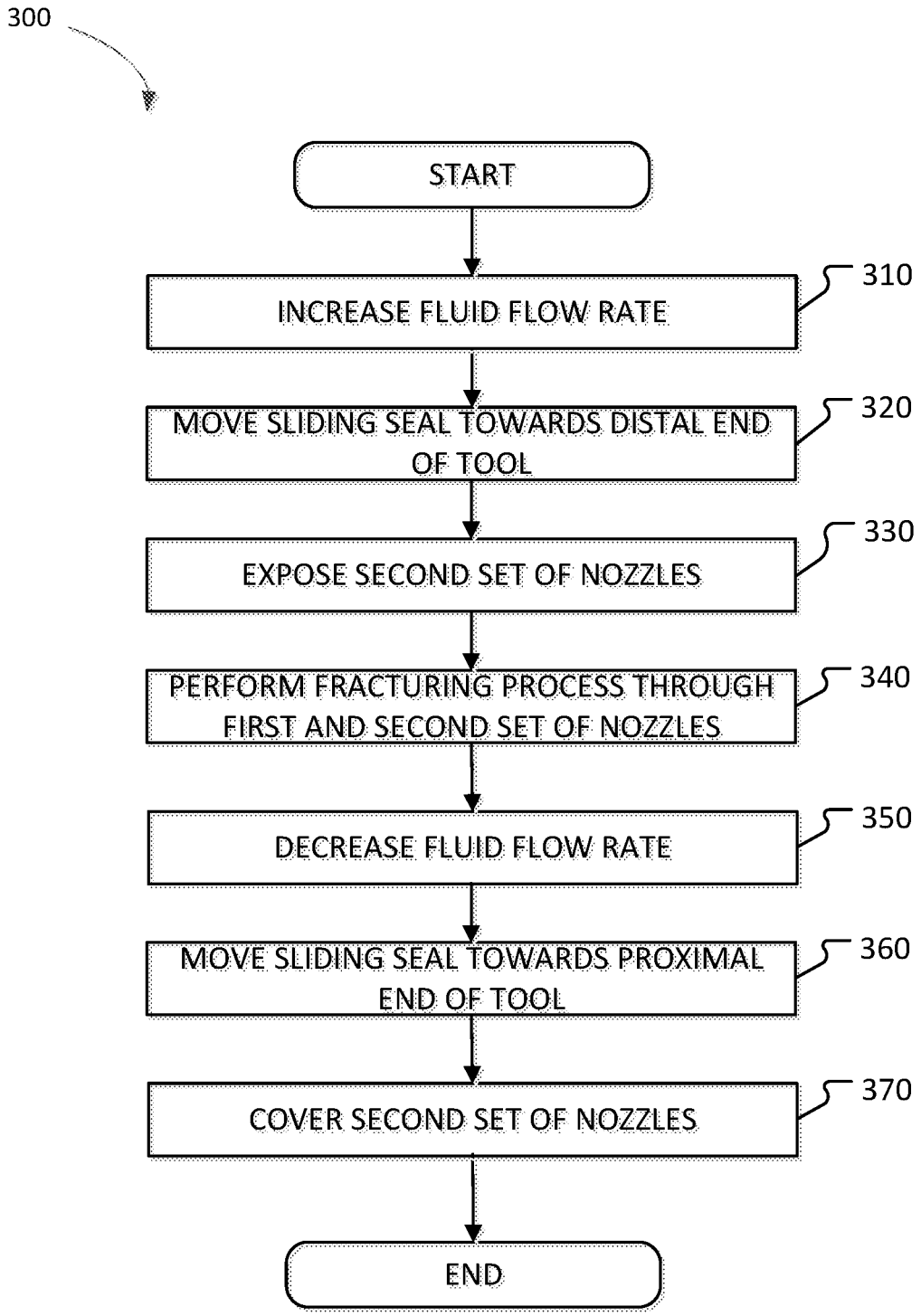
FIG. 3 depicts a method for a utilizing a tool, according to an embodiment.

FIG. 3 depicts a method 300 for a system utilizing an inner diameter of a sliding seal to expose nozzles, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, a flow rate of fluid flowing through the inner diameter of a tool may increase.

At operation 320, while increasing the fluid rate of the fluid flowing through the inner diameter of the tool, a sliding seal may simultaneously move to increase the size of a chamber. By changing the size of the chamber, the pressure within the chamber may remain substantially constant even when the fluid flow rate changes. Furthermore, while moving, a pressure adjustable member may apply a constant force (i.e. a spring force) against the sliding seal in a direction opposite that of the flowing fluid. The sliding seal may only be able to move responsive to forces created by the flowing fluid being greater than that of the constant force.

At operation 330, responsive to increasing the fluid flow rate beyond a flow rate threshold, the sliding seal may move below a set of nozzles, which may expose the nozzles to the flow of fluid.

At operation 340, the fluid may be pumped through the set of nozzles to perform a fracturing process.

At operation 350, the flow rate of fluid flowing through the inner diameter of a tool may decrease.

At operation 360, while decreasing the fluid rate of the fluid flowing through the inner diameter of the tool, the sliding seal may simultaneously move to decrease the size of a chamber. By changing the size of the chamber, the pressure within the chamber may remain substantially constant even when the fluid flow rate changes. Furthermore, the constant force applied by the pressure adjustable member may apply the constant force against the sliding seal to move the sliding seal.

At operation 370, responsive to decreasing the fluid flow rate below the flow rate threshold, the sliding seal may move above a set of nozzles, which may cover the nozzles to the flow of fluid.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A fracturing system comprising:

a first set of nozzles positioned at a first offset within a tool;

a second set of nozzles positioned at a second offset within the tool;

a sliding seal positioned within an inner diameter of the tool, the sliding seal being configured to move within a tool;

an adjustable member being configured to compress and elongate based on variations in pressure to apply a force against the sliding seal in a direction towards a proximal end of the tool, the adjustable member being positioned between the sliding seal and a distal end of the tool, wherein the adjustable member compresses responsive to increasing a fluid flow rate through the inner diameter of the tool, and the sliding seal is configured to move towards the distal end of the tool when the adjustable member compresses; and a chamber positioned between the sliding seal and the proximal end of the tool, wherein the chamber changes in size responsive to the adjustable member compressing or elongating, wherein the adjustable member is configured to elongate responsive to decreasing the fluid flow rate through the inner diameter of the tool, and the chamber decreases in size when the adjustable member compresses, wherein pressure within the chamber remains substantially constant when the fluid flow rate through the inner diameter of the tool changes by automatically changing the size of the chamber.

2. The fracturing system of claim 1, wherein in a first position the sliding seal is configured to cover the second set of nozzles, wherein in the first position the fluid flow rate through the inner diameter of the tool is below a flow rate threshold.

3. The fracturing system of claim 2, wherein in a second position the sliding seal is positioned below the second set of nozzles, wherein in the second position the fluid flow rate through the inner diameter of the tool is above the flow rate threshold.

4. The fracturing system of claim 1, wherein the first set of nozzles includes a first number of nozzles and the second set of nozzles includes a second number of nozzles, the second number being larger than the first number.

5. The fracturing system of claim 1, wherein the size of the chamber is based on a positioning of the sliding seal.

6. The fracturing system of claim 5, wherein the size of the chamber dynamically changes based on the fluid flow rate.

7. The fracturing system of claim 1, wherein the sliding seal is positioned between the first set of nozzles and the adjustable member.

8. A fracturing system comprising:

a first set of nozzles positioned at a first offset within a tool;

a second set of nozzles positioned at a second offset within the tool;

a sliding seal positioned within an inner diameter of the tool, the sliding seal being configured to move within a tool;

an adjustable member being configured to compress and elongate based on variations in pressure to apply a force against the sliding seal in a direction towards a proximal end of the tool, the adjustable member being positioned between the sliding seal and a distal end of the tool, wherein the adjustable member compresses responsive to increasing a fluid flow rate through the inner diameter of the tool, and the sliding seal is configured to move towards the distal end of the tool when the adjustable member compresses; and a chamber positioned between the sliding seal and the proximal end of the tool, wherein the chamber changes in size responsive to the adjustable member compressing or elongating; and a bleed off area between the sliding seal and the inner diameter of the tool.

9. A method utilizing a fracturing system comprising:

positioning a sliding sleeve within an inner diameter of a tool, the tool including a first set of nozzles positioned at a first offset within a tool and a second set of nozzles positioned at a second offset within the tool;

changing a fluid flow rate through the inner diameter of the tool;

compressing a adjustable member responsive to increasing the fluid flow rate;

elongating the adjustable member responsive to decreasing the fluid flow rate, wherein the adjustable member is configured to compress or elongate based on pressure;

applying a force via the adjustable member in a direction towards a proximal end of the tool, the adjustable member being positioned between the sliding seal and a distal end of the tool;

changing a size of a chamber positioned between the sliding seal and the proximal end of the tool responsive to the adjustable member compressing or elongating;

decreasing the size of the chamber when the adjustable member compresses;

maintaining a substantially constant pressure within the chamber when the fluid flow rate through the inner diameter of the tool changes by automatically changing the size of the chamber.

10. The method of claim 9, further comprising:

positioning the sliding seal in a first position to cover the second set of nozzles when the fluid flow rate through the inner diameter of the tool is below a flow rate threshold.

11. The method of claim 10, further comprising:

positioning the sliding seal in a second position below the second set of nozzles when the fluid flow rate through the inner diameter of the tool is above the flow rate threshold.

12. The method of claim 9, wherein the first set of nozzles includes a first number of nozzles and the second set of nozzles includes a second number of nozzles, the second number being larger than the first number.

13. The method of claim 9, wherein there is a bleed off area between the sliding seal and the inner diameter of the tool.

14. The method of claim 9, further comprising:

changing the size of the chamber by moving the sliding seal.

15. The method of claim 14, further comprising:

dynamically changing the size of the chamber based on the fluid flow rate.

16. The method of claim 9, wherein the sliding seal is positioned between the first set of nozzles and the adjustable member.

* * * * *